US008838443B2

(12) United States Patent
Yamanashi et al.

(10) Patent No.: US 8,838,443 B2
(45) Date of Patent: Sep. 16, 2014

(54) ENCODER APPARATUS, DECODER APPARATUS AND METHODS OF THESE

(75) Inventors: Tomofumi Yamanashi, Kanagawa (JP); Toshiyuki Morii, Kanagawa (JP); Hiroyuki Ehara, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 355 days.

(21) Appl. No.: 13/505,093

(22) PCT Filed: Nov. 11, 2010

(86) PCT No.: PCT/JP2010/006630

§ 371 (c)(1),
(2), (4) Date: Apr. 30, 2012

(87) PCT Pub. No.: WO2011/058752

PCT Pub. Date: May 19, 2011

(65) Prior Publication Data

US 2012/0215527 A1 Aug. 23, 2012

(30) Foreign Application Priority Data

Nov. 12, 2009 (JP) ..... 2009-258841

(51) Int. Cl.

| | |
|---|---|
| ***G10L 19/14*** | (2006.01) |
| ***G10L 19/12*** | (2013.01) |
| ***G10L 19/00*** | (2013.01) |
| ***G10L 21/038*** | (2013.01) |
| ***G10L 19/24*** | (2013.01) |

(52) U.S. Cl.

CPC ..... *G10L 21/038* (2013.01); *G10L 19/24* (2013.01)

USPC ..... 704/225; 704/205; 704/222; 704/223; 704/230; 704/500

(58) Field of Classification Search

USPC ..... 704/205, 222, 223, 224, 225, 229, 230, 704/500

See application file for complete search history.

(56) References Cited

U.S. PATENT DOCUMENTS

| | | | | |
|---|---|---|---|---|
| 7,885,819 | B2 * | 2/2011 | Koishida et al. | 704/500 |
| 7,937,272 | B2 | 5/2011 | Oomen et al. | |

(Continued)

FOREIGN PATENT DOCUMENTS

| | | |
|---|---|---|
| CN | 101297356 | 10/2008 |
| EP | 1953737 | 8/2008 |

(Continued)

OTHER PUBLICATIONS

"ITU-T:G.718: Frame error robust narrowband and wideband embedded variable bit-rate coding of speech and audio from 8-32 kbit/s", ITU-T Recommendation G. 718, 2008.

(Continued)

*Primary Examiner* — Edgar Guerra-Erazo

(74) *Attorney, Agent, or Firm* — Greenblum & Bernstein, P.L.C.

(57) ABSTRACT

There is disclosed an encoder apparatus whereby, when a band expanding technique for encoding, based on the spectral data of a lower frequency portion, the spectral data of a higher frequency portion is applied to a lower layer in a hierarchical encoding/decoding system, an efficient encoding can be performed in an upper layer as well, thereby improving the decoded-signal quality. In an encoder apparatus (101), a second layer decoder unit (207) calculates a spectrum (differential spectrum), which is to be encoded in a third layer encoder unit (210) that is an upper layer of the second layer decoder unit (207), by applying such an ideal gain (first gain parameter a1) that minimizes the energy of the differential spectrum.

18 Claims, 5 Drawing Sheets

(56) References Cited

U.S. PATENT DOCUMENTS

| | | | | |
|---|---|---|---|---|
| 7,953,604 | B2 * | 5/2011 | Mehrotra et al. | 704/500 |
| 8,285,555 | B2 * | 10/2012 | Oh et al. | 704/500 |
| 8,321,230 | B2 * | 11/2012 | Philippe et al. | 704/500 |
| 8,554,549 | B2 | 10/2013 | Oshikiri et al. | |
| 2003/0142746 | A1 | 7/2003 | Tanaka et al. | |
| 2005/0165611 | A1 * | 7/2005 | Mehrotra et al. | 704/500 |
| 2008/0120096 | A1 * | 5/2008 | Oh et al. | 704/211 |
| 2008/0154615 | A1 | 6/2008 | Oomen et al. | |
| 2009/0006103 | A1 * | 1/2009 | Koishida et al. | 704/500 |
| 2009/0171672 | A1 * | 7/2009 | Philippe et al. | 704/500 |
| 2009/0271204 | A1 | 10/2009 | Tammi | |
| 2009/0281811 | A1 | 11/2009 | Oshikiri et al. | |
| 2010/0017199 | A1 | 1/2010 | Oshikiri et al. | |
| 2010/0017204 | A1 | 1/2010 | Oshikiri et al. | |
| 2010/0076755 | A1 * | 3/2010 | Morii | 704/220 |
| 2010/0169081 | A1 * | 7/2010 | Yamanashi et al. | 704/203 |
| 2010/0274558 | A1 | 10/2010 | Yamanashi et al. | |
| 2010/0280833 | A1 | 11/2010 | Yamanashi et al. | |
| 2010/0332221 | A1 | 12/2010 | Yamanashi et al. | |
| 2013/0013321 | A1 * | 1/2013 | Oh et al. | 704/500 |
| 2013/0030820 | A1 * | 1/2013 | Oh et al. | 704/500 |
| 2013/0325457 | A1 | 12/2013 | Oshikiri et al. | |
| 2013/0332154 | A1 | 12/2013 | Oshikiri et al. | |

FOREIGN PATENT DOCUMENTS

| | | |
|---|---|---|
| JP | 2004-4530 | 1/2004 |
| JP | 2008-527439 | 7/2008 |
| JP | 2009-042740 | 2/2009 |
| JP | 2009-515212 | 4/2009 |
| WO | 2007/043648 | 4/2007 |
| WO | 2007/052088 | 5/2007 |
| WO | 2008/084688 | 7/2008 |
| WO | 2009/084221 | 7/2009 |

OTHER PUBLICATIONS

Tammi et al., "Scalable superwideband extension for wideband coding", ICASSP 2009, pp. 161-164.

Akio Jin et al., "Scalable Audio Coding Based on Hierarchical Transform Coding Modules", IEICE Transactions, vol. J83-A No. 3, Mar. 2000, pp. 241-252, with English language translation.

* cited by examiner

ENCODER APPARATUS, DECODER APPARATUS AND METHODS OF THESE

TECHNICAL FIELD

The present invention relates to a coding apparatus, a decoding apparatus, and methods thereof, which are used in a communication system that encodes and transmits a signal.

BACKGROUND ART

When a speech/audio signal is transmitted in a packet communication system typified by Internet communication, a mobile communication system, or the like, compression/coding technology is often used in order to increase speech/audio signal transmission efficiency. Furthermore, there is a growing demand for a technology of not simply encoding a speech/audio signal at a low bit rate but also encoding a wider band speech/audio signal in recent years.

In response to such a demand, various band extension technologies are being developed which encode a wideband speech/audio signal without drastically increasing the amount of coded information. For example, a technology is disclosed which applies gain information in a linear region and gain information in a logarithmic domain to spectrum data in a low-frequency part out of spectrum data obtained, for example, by converting an input audio signal corresponding to a certain time to generate spectrum data in a high-frequency part (see Patent Literature 1 and Non-Patent Literature 1). Furthermore, hierarchy coding schemes which encode a wideband signal in a hierarchical manner have been developed so far. For example, Non-Patent Literature 2 discloses a technology of encoding a wideband signal using a hierarchy coding scheme made up of five layers.

CITATION LIST

Patent Literature

PTL 1
WO2007/052088

Non-Patent Literature

NPTL 1
Mikko Tammi, Lasse Laaksonen, Anssi Ramo, and Henri Toukomaa, "Scalable Superwideband Extension for Wideband Coding", ICASSP 2009
NPTL 2
ITU-T:G.718; Frame error robust narrowband and wideband embedded variable bit-rate coding of speech and audio from 8-32 kbit/s. ITU-T Recommendation G.718 (2008)

SUMMARY OF INVENTION

Technical Problem

However, when the band extension technologies disclosed in Patent Literature 1 and Non-Patent Literature 1 are applied to a hierarchy coding/decoding scheme (scalable codec) such as the one disclosed in Non-Patent Literature 2, there is a problem that coding efficiency is not sufficient. For example, consider a case where a difference spectrum between a high-frequency spectrum generated by the above-described band extension technology and an input spectrum is encoded in a higher layer. In this case, the high-frequency spectrum generated through the above-described band extension technology is not close to the input spectrum in signal level. Therefore (that is, an S/N (Signal/Noise) ratio of the generated high-frequency spectrum is low), energy of the difference spectrum which is a coding target in the higher layer increases. Therefore, particularly when the bit rate of the higher layer is low, coding performance becomes insufficient and quality of the decoded signal may deteriorate significantly.

It is an object of the present invention to provide a coding apparatus, a decoding apparatus, and methods thereof, when a band extension technology of encoding spectrum data in a high-frequency part based on spectrum data in a low-frequency part according to a hierarchy coding/decoding scheme is applied to a lower layer, which can perform efficient encoding also in a higher layer and improve the quality of a decoded signal.

Solution to Problem

A coding apparatus of the present invention adopts a configuration including: a first coding section that inputs a low-frequency decoded signal of a frequency domain generated using low-frequency coded information obtained by encoding an input signal and the input signal of the frequency domain, generates a high-frequency decoded signal of the frequency domain using high-frequency coded information obtained through encoding using the low-frequency decoded signal and the input signal, generates a band extension signal using the low-frequency decoded signal and the high-frequency decoded signal and generates a difference signal between the input signal and the band extension signal; and a second coding section that encodes the difference signal to generate difference coded information, wherein: the first coding section searches a part approximate to the high-frequency part of the input signal from the low-frequency decoded signal in encoding using the low-frequency decoded signal and the input signal to thereby obtain an ideal gain that minimizes energy of the difference signal, generate the difference signal that minimizes the energy and generate the high-frequency coded information including the ideal gain.

A decoding apparatus of the present invention adopts a configuration including: a receiving section that receives coded information, which is generated by a coding apparatus, including low-frequency coded information obtained by encoding an input signal, high-frequency coded information obtained through encoding using a low-frequency signal generated using the low-frequency coded information and the input signal and difference coded information generated through encoding using a difference signal between a band extension signal and the input signal, the band extension signal generated using a high-frequency signal generated using the high-frequency coded information and the low-frequency signal, the coded information, the high-frequency coded information of which includes an ideal gain that minimizes energy of the difference signal; a first decoding section that decodes the low-frequency coded information to generate a low-frequency decoded signal; a second decoding section that performs decoding using the low-frequency decoded signal and the high-frequency coded information to thereby generate a high-frequency decoded signal; and a third decoding section that decodes the difference coded information, wherein: the receiving section generates control information indicating whether or not the coded information includes the difference coded information, and the second decoding section performs decoding by switching between a first decoding method using all information included in the high-frequency coded information and a second decoding method using information included in the high-frequency coded information except specific information, based on the control information.

A coding method of the present invention includes: a first encoding step of inputting a low-frequency decoded signal of a frequency domain generated using low-frequency coded information obtained by encoding an input signal and the input signal of the frequency domain, generating a high-frequency decoded signal of the frequency domain using high-frequency coded information obtained through encoding using the low-frequency decoded signal and the input signal, generating a band extension signal using the low-frequency decoded signal and the high-frequency decoded signal and generating a difference signal between the input signal and the band extension signal; and a second encoding step of encoding the difference signal to generate difference coded information, wherein: in the first encoding step, a part approximate to a high-frequency part of the input signal is searched from the low-frequency decoded signal in encoding using the low-frequency decoded signal and the input signal to thereby obtain an ideal gain that minimizes energy of the difference signal, generate the difference signal that minimizes the energy and generate the high-frequency coded information including the ideal gain.

A decoding method of the present invention includes: a receiving step of receiving coded information, that is generated by a coding apparatus, including low-frequency coded information obtained by encoding an input signal, high-frequency coded information obtained through encoding using a low-frequency signal generated using the low-frequency coded information and the input signal, and difference coded information generated through encoding using a difference signal between a band extension signal and the input signal, the band extension signal generated using a high-frequency signal generated using the high-frequency coded information and the low-frequency signal, the coded information, the high-frequency coded information of which includes an ideal gain that minimizes energy of the difference signal; a first decoding step of decoding the low-frequency coded information to generate a low-frequency decoded signal; a second decoding step of performing decoding using the low-frequency decoded signal and the high-frequency coded information to thereby generate a high-frequency decoded signal; and a third decoding step of decoding the difference coded information, wherein: in the receiving step, control information indicating whether or not the coded information includes the difference coded information is generated, and in the second decoding step, decoding is performed by switching between a first decoding method using all information included in the high-frequency coded information and a second decoding method using information included in the high-frequency coded information except specific information, based on the control information.

Advantageous Effects of Invention

According to the present invention, in a hierarchy coding/decoding scheme, when a band extension technology of encoding spectrum data in a high-frequency part is applied to a lower layer based on spectrum data in a low-frequency part, it is possible to efficiently perform encoding also in a higher layer and thereby improve the quality of the decoded signal.

DESCRIPTION OF EMBODIMENTS

Figure 1:
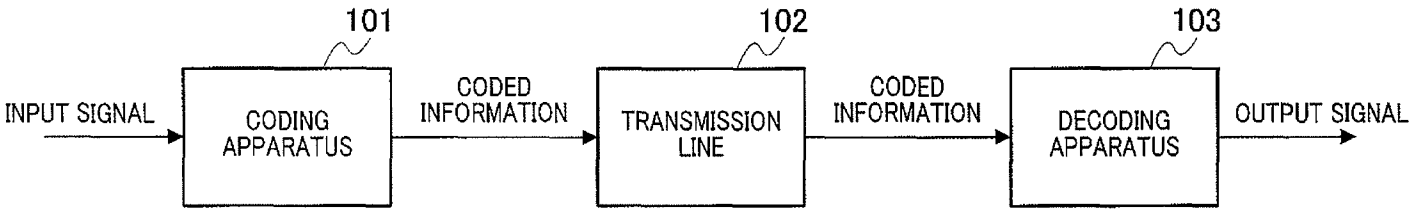
FIG. 1 is a block diagram illustrating a configuration of a communication system including a coding apparatus and a decoding apparatus according to an embodiment of the present invention.

Referring to the drawings, one embodiment of the present invention will be described in detail. A speech coding apparatus and a sound decoding apparatus are described as examples of the coding apparatus and decoding apparatus of the invention.

Embodiment

FIG. 1 is a block diagram illustrating a configuration of a communication system including a coding apparatus and a decoding apparatus according to Embodiment of the invention. In FIG. 1, the communication system includes coding apparatus 101 and decoding apparatus 103, and coding apparatus 101 and decoding apparatus 103 can conduct communication with each other through transmission line 102. Herein, the coding apparatus and decoding apparatus are usually mounted in a base station apparatus, a communication terminal apparatus, and the like for use.

Coding apparatus 101 divides an input signal into respective N samples (N is a natural number), and performs coding in each frame with the N samples as one frame. At this point, it is assumed that an input signal that becomes a coding target is expressed as $x_n$ (n=0, . . . , N−1). n denotes an (n+1)th signal element in the input signal that is divided every N sample. Coding apparatus 101 transmits encoded input information (hereinafter referred to as "coded information") to decoding apparatus 103 through transmission line 102.

Decoding apparatus 103 receives the coded information that is transmitted from coding apparatus 101 through transmission line 102, and decodes the coded information to obtain an output signal.

Figure 2:
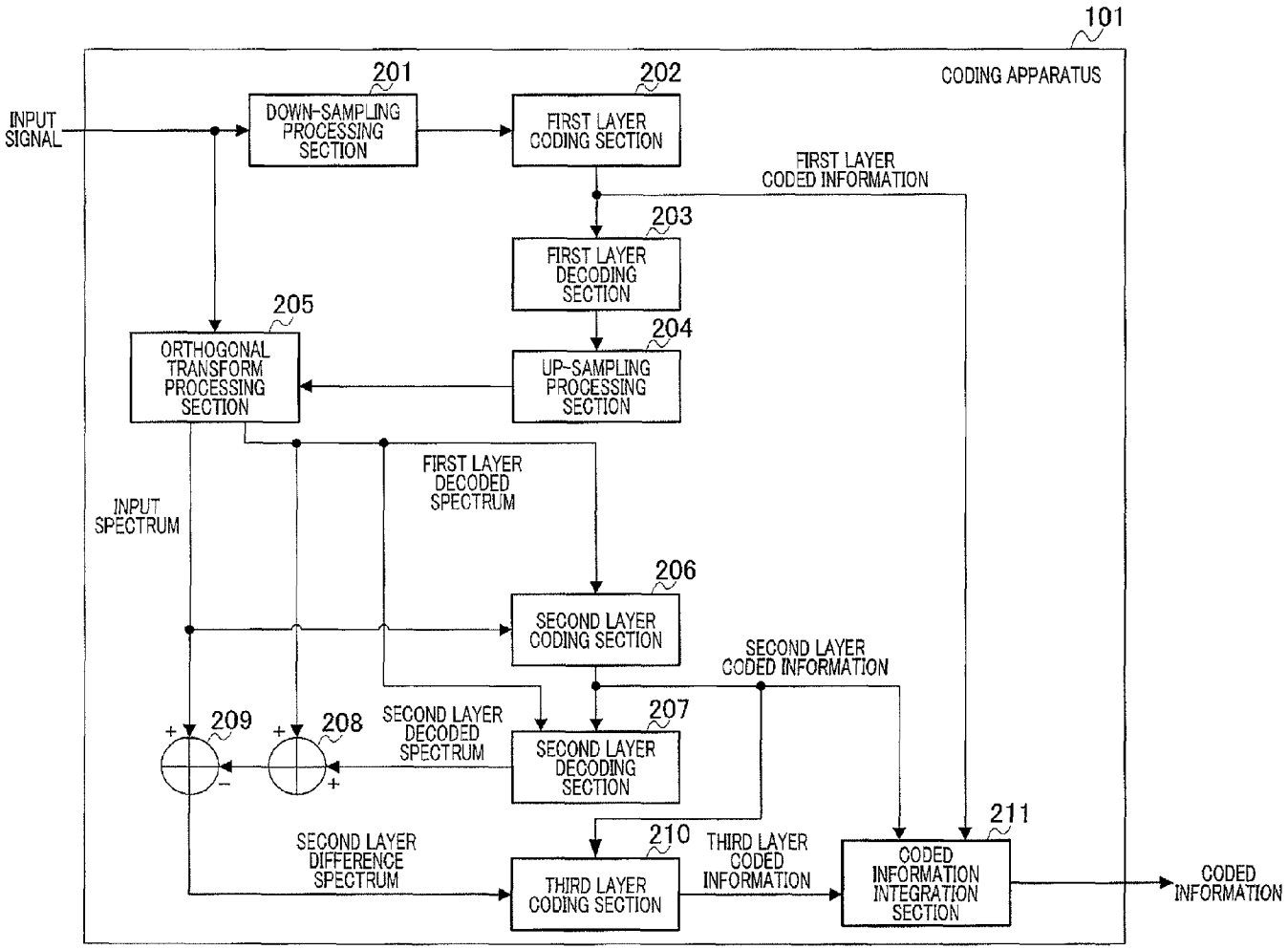
FIG. 2 is a block diagram illustrating a main internal configuration of the coding apparatus shown in FIG. 1.

FIG. 2 is a block diagram illustrating a main configuration of coding apparatus 101 in FIG. 1. Coding apparatus 101 is mainly constructed of down-sampling processing section 201, first layer coding section 202, first layer decoding section 203, up-sampling processing section 204, orthogonal transform processing section 205, second layer coding section 206, second layer decoding section 207, adder 208, adder 209, third layer coding section 210, and coded information integration section 211. Each section operates as follows.

When the sampling frequency of input signal $x_n$ is assumed to be $SR_{input}$, down-sampling processing section 201 down-samples the sampling frequency of input signal $x_n$ from $SR_{input}$ to $SR_{base}$ ($SR_{base}<SR_{input}$). Down-sampling processing section 201 outputs the down-sampled input signal to first layer coding section 202 as the down-sampled input signal.

First layer coding section 202 performs encoding on the down-sampled input signal inputted from down-sampling processing section 201 using, for example, a CELP (Code Excited Linear Prediction) speech coding method to generate first layer coded information. First layer coding section 202 outputs the generated first layer coded information to first layer decoding section 203 and coded information integration section 211.

First layer decoding section 203 decodes the first layer coded information inputted from first layer coding section 202 using, for example, a CELP-based speech decoding method to generate a first layer decoded signal. First layer decoding section 203 then outputs the generated first layer decoded signal to up-sampling processing section 204.

Up-sampling processing section 204 up-samples a sampling frequency of the first layer decoded signal inputted from first layer decoding section 203 from $SR_{base}$ to $SR_{input}$. Up-sampling processing section 204 outputs the up-sampled first layer decoded signal to orthogonal transform processing section 205 as up-sampled first layer decoded signal $x1_n$.

Orthogonal transform processing section 205 includes buffers $buf1_n$ and $buf2_n$ (n=0, . . . , N−1). Orthogonal transform processing section 205 applies modified discrete cosine transform (MDCT) to input signal $x_n$ and up-sampled first layer decoded signal $x1_n$ inputted from up-sampling processing section 204.

An orthogonal transform processing in orthogonal transform processing section 205, namely, an orthogonal transform processing calculating procedure and data output to an internal buffer will be described below.

First, orthogonal transform processing section 205 initializes buffers $buf1_n$ and $buf2_n$ according to equation 1 and equation 2 below assuming "0" as an initial value.

(Equation 1)

$$buf1_n=0(n=0, \ldots, N-1) \quad [1]$$

(Equation 2)

$$buf2_n=0(n=0, \ldots, N-1) \quad [2]$$

Next, orthogonal transform processing section 205 applies modified discrete cosine transform (MDCT) to input signal $x_n$ and up-sampled first layer decoded signal $x1_n$ according to equation 3 and equation 4 below. Orthogonal transform processing section 205 thereby calculates MDCT coefficient (hereinafter referred to as "input spectrum") X(k) of the input signal and MDCT coefficient (hereinafter referred to as "first layer decoded spectrum") X1(k) of up-sampled first layer decoded signal $x1_n$.

(Equation 3)

$$X(k) = \frac{2}{N}\sum_{n=0}^{2N-1} x'_n \cos\left[\frac{(2n+1+N)(2k+1)\pi}{4N}\right] \quad [3]$$

$$(k = 0, \ldots, N-1)$$

(Equation 4)

$$X1(k) = \frac{2}{N}\sum_{n=0}^{2N-1} x1'_n \cos\left[\frac{(2n+1+N)(2k+1)\pi}{4N}\right] \quad [4]$$

$$(k = 0, \ldots, N-1)$$

Where k is an index of each sample in one frame. Using following equation 5, orthogonal transform processing section 205 obtains $x_n'$ that is a vector formed by coupling input signal $x_n$ and buffer $buf1_n$. Furthermore, using equation 6 below, orthogonal transform processing section 205 obtains $x1_n'$ that is a vector formed by coupling up-sampled first layer decoded signal $x1_n$ and buffer $buf2_n$.

(Equation 5)

$$x'_n = \begin{cases} buf1_n & (n = 0, \ldots N-1) \\ x_{n-N} & (n = N, \ldots 2N-1) \end{cases} \quad [5]$$

(Equation 6)

$$x1'_n = \begin{cases} buf2_n & (n = 0, \ldots N-1) \\ x1_{n-N} & (n = N, \ldots 2N-1) \end{cases} \quad [6]$$

Next, orthogonal transform processing section 205 updates buffers $buf1_n$ and $buf2_n$ according to equation 7 and equation 8.

(Equation 7)

$$buf1_n=x_n(n=0, \ldots N-1) \quad [7]$$

(Equation 8)

$$buf2_n=x1_n(n=0, \ldots N-1) \quad [8]$$

Orthogonal transform processing section 205 then outputs input spectrum X(k) to second layer coding section 206 and adder 209. Furthermore, orthogonal transform processing section 205 outputs first layer decoded spectrum X1(k) to second layer coding section 206, second layer decoding section 207, and adder 208.

Second layer coding section 206 generates second layer coded information using input spectrum X(k) and first layer decoded spectrum X1(k), both of which are inputted from orthogonal transform processing section 205. Second layer coding section 206 outputs the generated second layer coded information to second layer decoding section 207, third layer coding section 210, and coded information integration section 211. The details of second layer coding section 206 will be described later.

Second layer decoding section 207 decodes the second layer coded information inputted from second layer coding section 206 to generate a second layer decoded spectrum. Second layer decoding section 207 outputs the generated second layer decoded spectrum to adder 208. The details of second layer decoding section 207 will be described later.

Adder 208 adds up the first layer decoded spectrum inputted from orthogonal transform processing section 205 and the second layer decoded spectrum inputted from second layer decoding section 207 in a frequency domain to calculate an addition spectrum. Here, the first layer decoded spectrum is a spectrum that has a value in a low-frequency part (0(kHz) to $F_{base}$(kHz)) corresponding to sampling frequency $SR_{base}$. Furthermore, the second layer decoded spectrum is a spectrum that has a value in a high-frequency part ($F_{base}$(kHz) to $F_{input}$(kHz)) corresponding to sampling frequency $SR_{input}$. That is, the value in the low-frequency part (0(kHz) to $F_{base}$ (kHz)) of an addition spectrum obtained by adding up these spectra is a first layer decoded spectrum and the value in the high-frequency part ($F_{base}$(kHz) to $F_{input}$(kHz)) is a second layer decoded spectrum.

Adder 209 adds the addition spectrum inputted from adder 208 to input spectrum X(k) inputted from orthogonal transform processing section 205 while inverting the polarity of the addition spectrum, thereby calculating a second layer difference spectrum. Adder 209 outputs the calculated second layer difference spectrum to third layer coding section 210.

Third layer coding section 210 encodes the second layer difference spectrum inputted from adder 209 and the second layer coded information inputted from second layer coding section 206 to generate third layer coded information. Third layer coding section 210 outputs the generated third layer coded information to coded information integration section 211. The details of third layer coding section 210 will be described later.

Coded information integration section 211 integrates the first layer coded information inputted from first layer coding section 202, the second layer coded information inputted from second layer coding section 206, and the third layer coded information inputted from third layer coding section 210. Coded information integration section 211 adds a transmission error code or the like to the integrated information source code as required and outputs the resulting code to transmission line 102 as coded information.

Next, the processing in second layer coding section 206 will be described. The processing in second layer coding section 206 is similar to the processing of "High frequency Coding" shown in FIG. 7 of Patent Literature 1. That is, second layer coding section 206 calculates parameters (spectrum index i, first gain parameter $\alpha_1$, second gain parameter $\alpha_2$ in Patent Literature 1) from the first layer decoded spectrum ($\hat{X}_L(k)$ in FIG. 7 of Patent Literature 1) and the input spectrum ($X_H(k)$ in FIG. 7 of Patent Literature 1) to generate a high-frequency spectrum at the decoding apparatus side. As described above, the first layer decoded spectrum is a spectrum in the low-frequency part (0(kHz) to $F_{base}$(kHz)) and the input spectrum is a spectrum in the high-frequency part ($F_{base}$ (kHz) to $F_{input}$(kHz)). Suppose the above-described three parameters which will be used in the following description are parameters calculated using the method disclosed in Patent Literature 1.

Here, the method of calculating the above-described three parameters disclosed in Patent Literature 1 and Non-Patent Literature 1 will be described.

First, a part similar to the spectrum in the high-frequency part ($F_{base}$(kHz) to $F_{input}$(kHz)) of input spectrum X(k) is searched with respect to first layer decoded spectrum X1(k). To be more specific, a spectrum index where the value (S(d)) in equation 9 below is maximized is searched and this spectrum index is assumed to be i. Here, j in equation 9 is a sub-band index, d is a spectrum index during the search and $n_j$ is a search range (the number of search entries) with respect to sub-band j.

(Equation 9)

$$S(d) = \left| \frac{\sum_{k=0}^{n_j-1} \left(X_H^j(k)\hat{X}_L(d+k)\right)}{\sqrt{\sum_{k=0}^{n_j-1} \hat{X}_L(d+k)^2}} \right| \quad [9]$$

Next, first gain parameter $\alpha_1$ is calculated according to equation 10 using spectrum index i that maximizes equation 9.

(Equation 10)

$$\alpha_1(j) = \frac{\sum_{k=0}^{n_j-1} \left(X_H^j(k)\hat{X}_L^j(d+k)\right)}{\sum_{k=0}^{n_j-1} \hat{X}_L^j(d+k)^2} \quad [10]$$

Next, second gain parameter $\alpha_2$ is calculated according to equation 11 using spectrum index i and gain parameter $\alpha_1$ calculated according to equation 9 and equation 10.

(Equation 11)

$$\alpha_2(j) = \frac{\sum_{k=0}^{n_j-1} \left(\left(\log_{10}\left(\left|\alpha_1(j)\hat{X}_L^j(k)\right| - M_j\right)\right)\right)}{\sum_{k=0}^{n_j-1} \left(\log_{10}\left(\left|\alpha_1(j)\hat{X}_L^j(k)\right| - M_j\right)\right)^2} \quad [11]$$

Here, suppose Mj in equation 11 is a value that satisfies equation 12 below.

(Equation 12)

$$M_j = \max_k \left(\log_{10}\left(\left|\alpha_1(j)\hat{X}_L^j(k)\right|\right)\right) \quad [12]$$

That is, in the second coding layer, the most approximate part to the high-frequency part of the input spectrum is searched with respect to the first decoded spectrum first. In this search, spectrum index i indicating the approximate spectrum part as well as an ideal gain at that time is calculated as first gain parameter $\alpha_1$. Then, second gain parameter $\alpha_2$ which is a gain parameter to adjust energy in the logarithmic domain is calculated with respect to the high-frequency spectrum calculated from spectrum index i and first gain parameter $\alpha_1$ being an ideal gain at that time, and the high-frequency part of the input spectrum.

Next, the processing in second layer decoding section 207 will be described. The processing in second layer decoding section 207 is identical to part of the processing in "High frequency generation" shown in FIG. 7 of Patent Literature 1.

First, second layer decoding section 207 generates high-frequency spectrum $X1'^j_H(k)$ in the high-frequency part ($F_{base}$(kHz) to $F_{input}$(kHz)) as shown in equation 13. That is, second layer decoding section 207 generates high-frequency spectrum $X1'^j_H(k)$ from spectrum index i out of the parameters (spectrum index i, first gain parameter $\alpha_1$, second gain parameter $\alpha_2$) included in the second layer coded information, and from first layer decoded spectrum X1(k). Here, suppose j in equation 13 is a sub-band index and spectrum index i is set for each sub-band. Furthermore, here, spectrum index i, first gain parameter $\alpha_1$, and second gain parameter $\alpha_2$ are parameters calculated using the method (described above) disclosed in Patent Literature 1.

That is, equation 13 represents the processing of approximating the spectrum corresponding to the sub-band width of sub-band index j from the index indicated by spectrum index of the first decoded spectrum onward, as a spectrum of the high-frequency part.

(Equation 13)

$$X1'^j_H(k) = X1(k-i_j)(j=0, \ldots, L-1) \quad [13]$$

Next, second layer decoding section 207 multiplies high-frequency spectrum $X1'^j_H(k)$ calculated according to equation 13 by first gain parameter $\alpha_1$ as shown in equation 14 below to calculate second layer decoded spectrum $X2^j_H(k)$.

(Equation 14)

$$X2_H^j(k)=\alpha_1(j)\cdot X1'^j_H(k)(j=0,\ldots,L-1) \quad [14]$$

Next, second layer decoding section 207 outputs second layer decoded spectrum $X2^j_H(k)$ calculated according to equation 14 to adder 208.

That is, second layer decoding section 207 of the present embodiment generates a high-frequency spectrum (second layer decoded spectrum) without using second gain parameter $\alpha_2$ unlike "High frequency generation" shown in FIG. 7 of Patent Literature 1. This is intended to reduce the energy of the second layer difference spectrum which is a quantization target in the higher layer and this processing allows coding efficiency to be improved in the higher layer.

Figure 3:
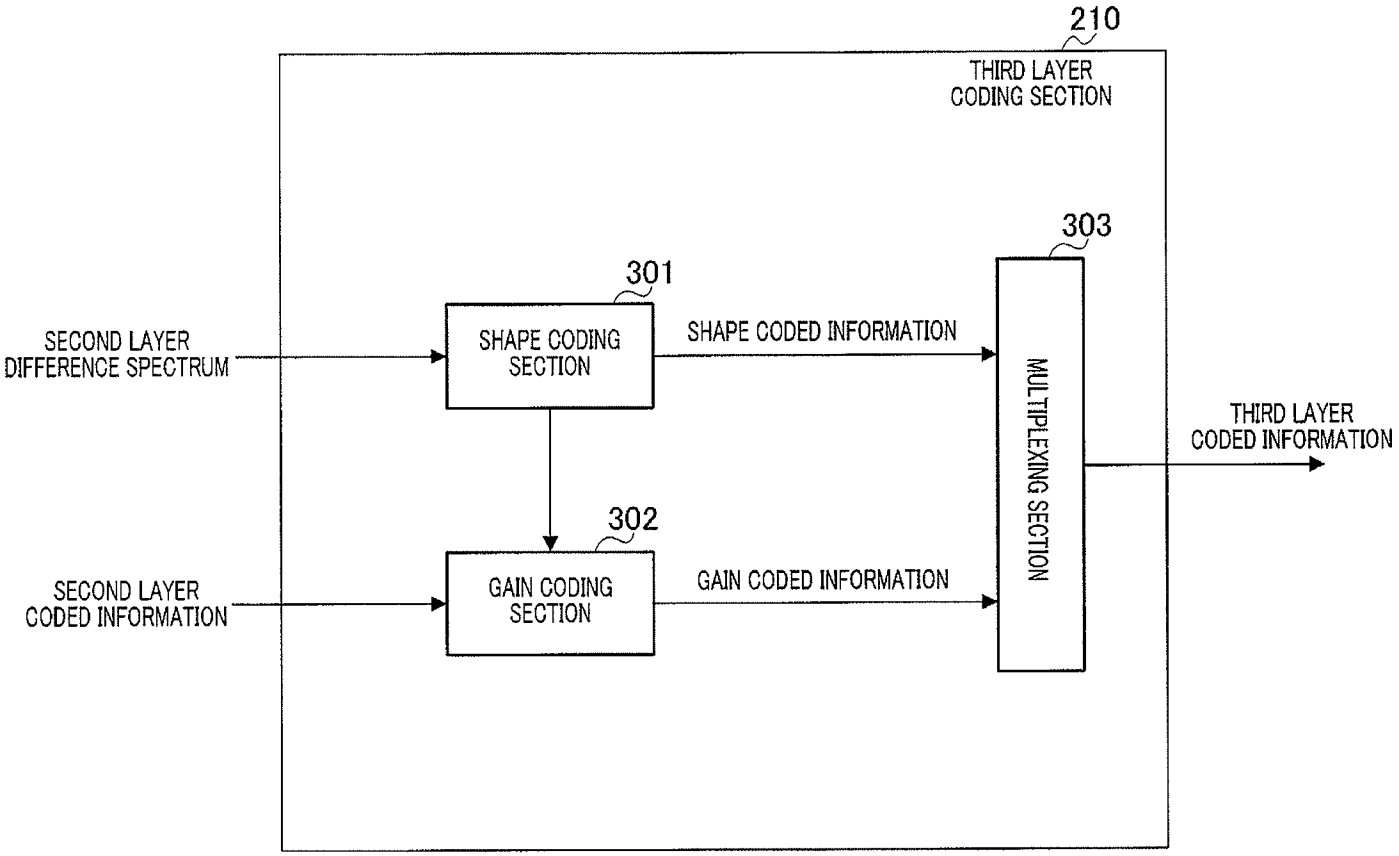
FIG. 3 is a block diagram illustrating a main internal configuration of the third layer coding section shown in FIG. 2.

Next, the processing in third layer coding section 210 will be described. FIG. 3 is a block diagram illustrating an internal configuration of third layer coding section 210. As shown in FIG. 3, third layer coding section 210 is mainly constructed of shape coding section 301, gain coding section 302 and multiplexing section 303. Each section operates as follows.

Shape coding section 301 performs shape quantization on the second layer difference spectrum inputted from adder 209 for each sub-band. To be more specific, shape coding section 301 divides the second layer difference spectrum into L sub-bands first. Here, suppose the number of sub-bands L is the same as the number of sub-bands in second layer coding section 206. Next, shape coding section 301 searches a built-in shape codebook made up of SQ shape code vectors with respect to each of the L sub-bands and obtains an index of a shape code vector in which evaluation scale Shape_q(i) in equation 15 below is maximized.

(Equation 15)

$$\text{Shape_q}(i)=\frac{\left\{\sum_{k=0}^{W(j)}(X2'^j_H(k)\cdot SC^i_k)\right\}^2}{\sum_{k=0}^{W(j)}SC^i_k\cdot SC^i_k} \quad [15]$$

$$(j=0,\ldots,L-1,\ i=0,\ldots,SQ-1)$$

Where $SC^i_k$ is the shape code vector constituting the shape code book, i is the index of the shape code vector, and k is the index of the element of the shape code vector. Furthermore, W(j) denotes the band width of a band whose band index is j. Furthermore, suppose $X2'^j_H(k)$ denotes a value of the second layer difference spectrum whose band index is j.

Shape coding section 301 outputs index S_max of a shape code vector in which evaluation scale Shape_q(i) of equation 15 above is maximized to multiplexing section 303 as the shape coded information. Shape coding section 301 calculates ideal gain Gain_i(j) according to following equation (16), and outputs calculated ideal gain Gain_i(j) to gain coding section 302.

(Equation 16)

$$\text{Gain_i}(j)=\frac{\sum_{k=0}^{W(j)}\left(X2'^j_H(k)\cdot SC^{S_max}_k\right)}{\sum_{k=0}^{W(j)}SC^{S_max}_k\cdot SC^{S_max}_k} \quad [16]$$

$$(j=0,\ldots,L-1)$$

Gain coding section 302 receives ideal gain Gain_i(j) from shape coding section 301. Furthermore, gain coding section 302 receives the second layer coded information from second layer coding section 206 as input.

Gain coding section 302 quantizes ideal gain Gain_i(j) inputted from shape coding section 301 according to following equation (17). Here, gain coding section 302 also deals with the ideal gain as an L-dimensional vector and performs vector quantization. Furthermore, in equation 17, β(j) is a preset constant and hereinafter will be referred to as a "predictive gain." Predictive gain β(j) will be described later.

(Equation 17)

$$\text{Gain_q}(i)=\left\{\sum_{j=0}^{L-1}\{\text{Gain_i}(j)-\beta(j)-GC^i_j\}\right\}^2 \quad [17]$$

$$(i=0,\ldots,GQ-1)$$

Where $GC^i_j$ is the gain code vector constituting the gain code book, i is the index of the gain code vector, and j is the index of the element of the gain code vector.

Gain coding section 302 searches the built-in gain codebook made up of GQ gain code vectors, and outputs index G_min of the gain codebook that minimizes equation 17 above to multiplexing section 303 as the gain coded information.

Next, a method of setting predictive gain β(j) in equation 17 will be described. Predictive gain β(j) is a constant preset for each sub-band (j is a sub-band index), the constant preset corresponding to second gain parameter $\alpha_2$ in second layer coding section 206, and is stored together in the codebook used when second gain parameter $\alpha_2$ is quantized. That is, predictive gain β(j) is set for each code vector when second gain parameter $\alpha_2$ is quantized. This allows decoding apparatus 103 (also including local decoding processing in coding apparatus 101) to obtain predictive gain β(j) corresponding to second gain parameter $\alpha_2$ without using any additional amount of information. The value of predictive gain β(j) is a numerical value determined after statistically analyzing what type of value ideal gain Gain_i(j) calculated in shape coding section 301 at that time is with respect to the value of second gain parameter $\alpha_2$.

To be more specific, when the value of second gain parameter $\alpha_2$ is large (close to 1.0), the energy of the second difference spectrum tends to be relatively small. Therefore, in such a case, the value of predictive gain β(j) is small. Furthermore, when the value of second gain parameter $\alpha_2$ is small (close to 0.0), the energy of the second difference spectrum tends to be relatively large. Therefore, in such a case, the value of predictive gain β(j) is large.

Using such a characteristic, gain coding section 302 receives very long sample data as input and statistically analyzes the value of ideal gain Gain_i(j) corresponding to the value of second gain parameter $\alpha_2$. Gain coding section 302 determines the value of predictive gain β(j) corresponding to each value of second gain parameter $\alpha_2$ stored in the codebook of second gain parameter $\alpha_2$. The method of setting predictive gain β(j) using equation 17 has been described above.

Multiplexing section 303 multiplexes shape coded information S_max inputted from shape coding section 301 and gain coded information G_min inputted from gain coding section 302, and outputs the multiplexed information to coded information integration section 211 as the third layer coded information.

The configuration of third layer coding section 210 has been described above.

The configuration of coding apparatus 101 has been described above.

Next, decoding apparatus 103 shown in FIG. 1 will be described.

Figure 4:
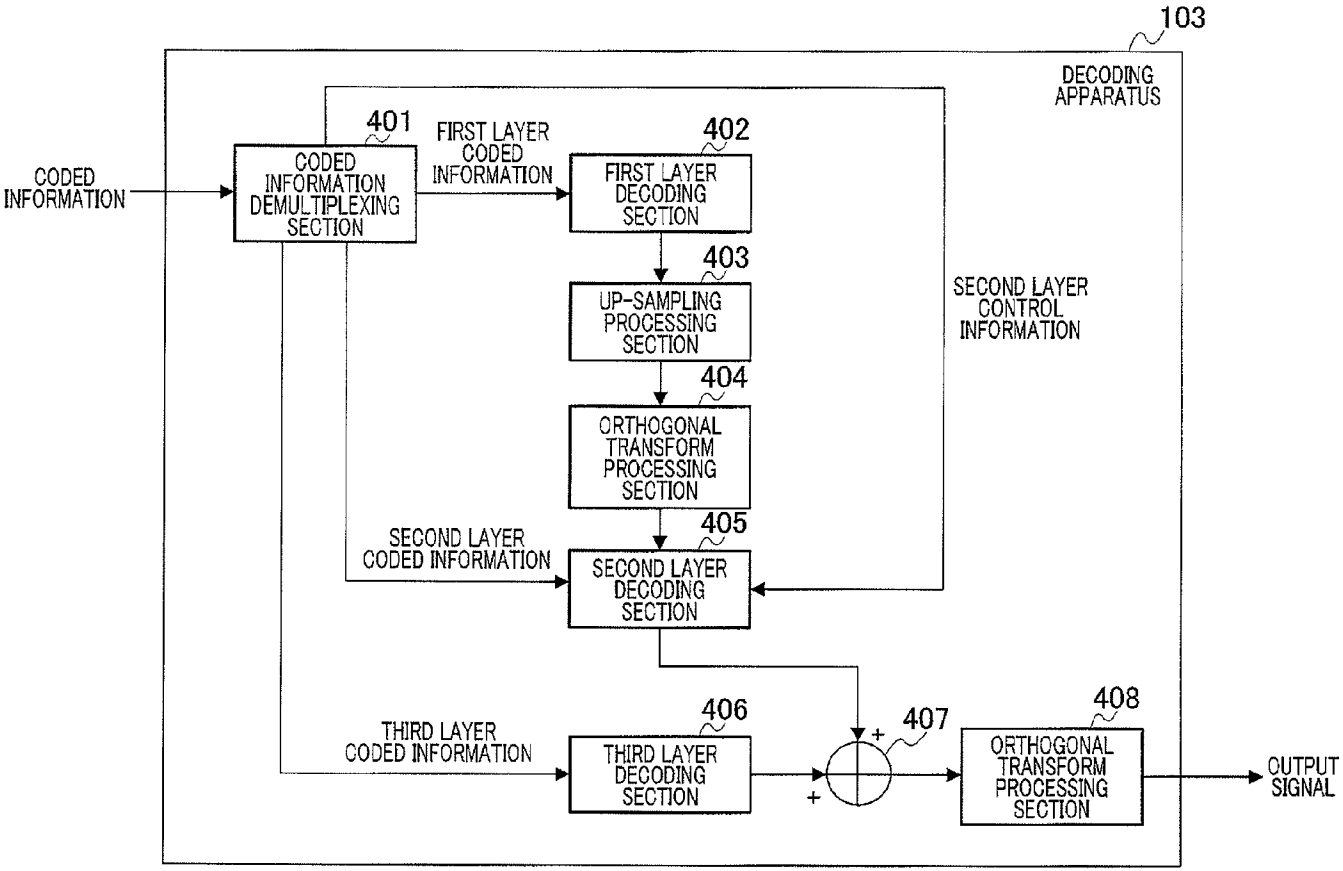
FIG. 4 is a block diagram illustrating a main internal configuration of the decoding apparatus shown in FIG. 1.

FIG. 4 is a block diagram illustrating a main internal configuration of decoding apparatus 103. Decoding apparatus 103 is mainly constructed of coded information demultiplexing section 401, first layer decoding section 402, up-sampling processing section 403, orthogonal transform processing section 404, second layer decoding section 405, third layer decoding section 406, adder 407, and orthogonal transform processing section 408. Each section operates as follows.

Coded information demultiplexing section 401 receives the coded information transmitted from coding apparatus 101 via transmission line 102. Coded information demultiplexing section 401 demultiplexes the coded information into first layer coded information, second layer coded information, and third layer coded information. Next, coded information demultiplexing section 401 outputs the first layer coded information to first layer decoding section 402, outputs the second layer coded information to second layer decoding section 405, and outputs the third layer coded information to third layer decoding section 406.

Furthermore, coded information demultiplexing section 401 detects whether or not the coded information includes the third layer coded information and controls the operation of second layer decoding section 405 according to the detection result. To be more specific, when the coded information includes the third layer coded information, coded information demultiplexing section 401 sets the value of second layer control information CI to 0 and sets the value of second layer control information CI to 1 otherwise. Next, coded information demultiplexing section 401 outputs second layer control information CI to second layer decoding section 405.

First layer decoding section 402 performs decoding on the first layer coded information inputted from coded information demultiplexing section 401 using, for example, a CELP-based speech decoding method to generate a first layer decoded signal. First layer decoding section 402 outputs the generated first layer decoded signal to up-sampling processing section 403.

Up-sampling processing section 403 up-samples the sampling frequency of the first layer decoded signal, inputted from first layer decoding section 402, from $SR_{base}$ to $SR_{input}$. Up-sampling processing section 403 outputs the up-sampled first layer decoded signal to orthogonal transform processing section 404 as the up-sampled first layer decoded signal.

Orthogonal transform processing section 404 incorporates buffer $buf3_n$ (n=0, . . . , N−1), and performs modified discrete cosine transform (MDCT) on up-sampled first layer decoded signal $x1_n$ inputted from up-sampling processing section 403. Orthogonal transform processing section 404 performs orthogonal transform processing on up-sampled first layer decoded signal $x1_n$ to calculate first layer decoded spectrum X1(k). Since the processing in orthogonal transform processing section 404 is similar to the processing in orthogonal transform processing section 205, descriptions thereof will be omitted. Orthogonal transform processing section 404 outputs first layer decoded spectrum X1(k) obtained to second layer decoding section 405.

Second layer decoding section 405 receives the second layer coded information and second layer control information from coded information demultiplexing section 401 as input. Furthermore, second layer decoding section 405 also receives first layer decoded spectrum X1(k) from orthogonal transform processing section 404 as input. Second layer decoding section 405 switches between decoding methods according to the value of the second layer control information and calculates a second layer decoded spectrum from first layer decoded spectrum X1(k) and the second layer coded information. Next, second layer decoding section 405 calculates a first addition spectrum from the second layer decoded spectrum and the first layer decoded spectrum and outputs the first addition spectrum to adder 407. The details of second layer coding section 405 will be described later.

Third layer decoding section 406 receives the third layer coded information from coded information demultiplexing section 401. Third layer decoding section 406 decodes the third layer coded information to calculate a third layer decoded spectrum. Next, third layer decoding section 406 outputs the calculated third layer decoded spectrum to adder 407. The details of third layer coding section 406 will be described later.

Adder 407 receives the first addition spectrum from second layer decoding section 405 as input. Furthermore, adder 407 receives the third layer decoded spectrum from third layer decoding section 406 as input. Adder 407 adds up the first addition spectrum and the third layer decoded spectrum on the frequency axis to calculate the second addition spectrum. Next, adder 407 outputs the calculated second addition spectrum to orthogonal transform processing section 408.

Orthogonal transform processing section 408 applies orthogonal transform to the second addition spectrum inputted from adder 407 to convert the second addition spectrum to a time-domain signal. Orthogonal transform processing section 408 outputs the signal obtained as an output signal. The details of the processing of orthogonal transform processing section 408 will be described later.

Next, the processing of second layer decoding section 405 will be described. The processing of second layer decoding section 405 is partially identical to that of second layer decoding section 207 in coding apparatus 101.

Second layer decoding section 405 generates high-frequency spectrum $X1'^{j}_{H}(k)$ of the high-frequency part ($F_{base}$ (kHz) to $F_{input}$(kHz)) as shown in equation 13 above. That is, second layer decoding section 405 generates high-frequency spectrum $X1'^{j}_{H}(k)$ from spectrum index i and first layer decoded spectrum X1(k) among parameters (spectrum index i, first gain parameter $\alpha_1$, second gain parameter $\alpha_2$) included in the second layer coded information. Here, in equation 13, suppose j is a sub-band index and spectrum index i is set for each sub-band. Furthermore, spectrum index i, first gain parameter $\alpha_1$, and second gain parameter $\alpha_2$ here are parameters calculated using the (above-described) method disclosed in Patent Literature 1.

That is, equation 13 indicates processing of approximating a spectrum corresponding to a sub-band width of sub-band index i from an index indicated by spectrum index $i_j$ of first decoded spectrum onward, as a spectrum of the high-frequency part.

Next, second layer decoding section 405 multiplies high-frequency spectrum $X1'^{j}_{H}(k)$ calculated according to equation 13 by first gain parameter $\alpha_1$ as shown in equation 18 to calculate high-frequency spectrum $X1''^{j}_{H}(k)$.

(Equation 18)

$$X1''^{j}_{H}(k)=\alpha_1(j)\cdot X1'^{j}_{H}(k) \quad [18]$$

Next, second layer decoding section 405 calculates second layer decoded spectrum $X2^{j}_{H}(k)$ according to equation 19 below depending on the value of inputted second layer control information CI. Here, in equation 19, ζ(k) is a variable which is −1 when the value of high-frequency spectrum $X1''^{j}_{H}(k)$ is negative and +1 otherwise. Furthermore, $M_j$ is a value that satisfies equation 20 below.

(Equation 19)

$$X2^{j}_{H}(k) = \begin{cases} X1''^{j}_{H}(k) & (\text{if } CI = 0) \\ \zeta(k) \cdot 10^{\alpha_2(j)(\log_{10}(|X1^{*j}_{H}(k)|) - M_j) + M_j} & (\text{if } CI = 1) \end{cases} \quad [19]$$

$$(j = 0, \ldots, L-1)$$

(Equation 20)

$$M_j = \max_k (\log_{10}(X1''^{j}_{H}(k))) \quad [20]$$

$$(j = 0, \ldots, L-1)$$

When the value of second layer control information CI is 0, that is, when the coded information includes the third layer coded information, second layer decoding section 405 calculates the second layer decoded spectrum using a method similar to the method calculated by second layer decoding section 207 in coding apparatus 101. Furthermore, when the value of second layer control information CI is 1, that is, when the coded information does not include the third layer coded information, second layer decoding section 405 calculates a second layer decoded spectrum using a method different from the method calculated by second layer decoding section 207. To be more specific, when the value of second layer control information CI is 1, second layer decoding section 405 calculates a second layer decoded spectrum using a gain parameter (second gain parameter $\alpha_2$) in the logarithmic domain as disclosed in Patent Literature 1 and Non-Patent Literature 1.

As described above, adder 407 adds up the first addition spectrum decoded in second layer decoding section 405, and the third layer decoded spectrum decoded in third layer decoding section 406 which is a higher layer of second layer decoding section 405. Therefore, when a third decoded spectrum, which is a higher layer, exists, second layer decoding section 405 adopts a decoding method corresponding to second layer decoding section 207 in coding apparatus 101. Thus, adder 407 is designed so as to calculate the most accurate spectrum after the addition.

On the other hand, when the third decoded spectrum of the higher layer does not exist, the first addition spectrum is not added to the third layer decoded spectrum. For this reason, second layer decoding section 405 adopts a decoding method that makes the signal perceptually closer to the input signal although the signal level (SNR) is lowered.

Next, second layer decoding section 405 adds up second layer decoded spectrum $X2^{j}_{H}(k)$ calculated according to equation 19 and first layer decoded spectrum X1(k) in the frequency domain to calculate a first addition spectrum. Here, first layer decoded spectrum X1(k) is a spectrum that has a value in the low-frequency part (0(kHz) to $F_{base}$(kHz)) corresponding to sampling frequency $SR_{base}$. Furthermore, second layer decoded spectrum $X2^{j}_{H}(k)$ is a spectrum that has a value in the high-frequency part ($F_{base}$(kHz) to $F_{input}$(kHz)) corresponding to sampling frequency $SR_{input}$. That is, the value of the low-frequency part (0(kHz) to $F_{base}$(kHz)) of the first addition spectrum obtained by adding up these spectra is a first layer decoded spectrum. Furthermore, the value of the high-frequency part ($F_{base}$(kHz) to $F_{input}$(kHz)) is a second layer decoded spectrum. This addition processing is similar to the processing of adder 208 in coding apparatus 101.

Next, second layer decoding section 405 outputs the calculated first addition spectrum to adder 407.

Figure 5:
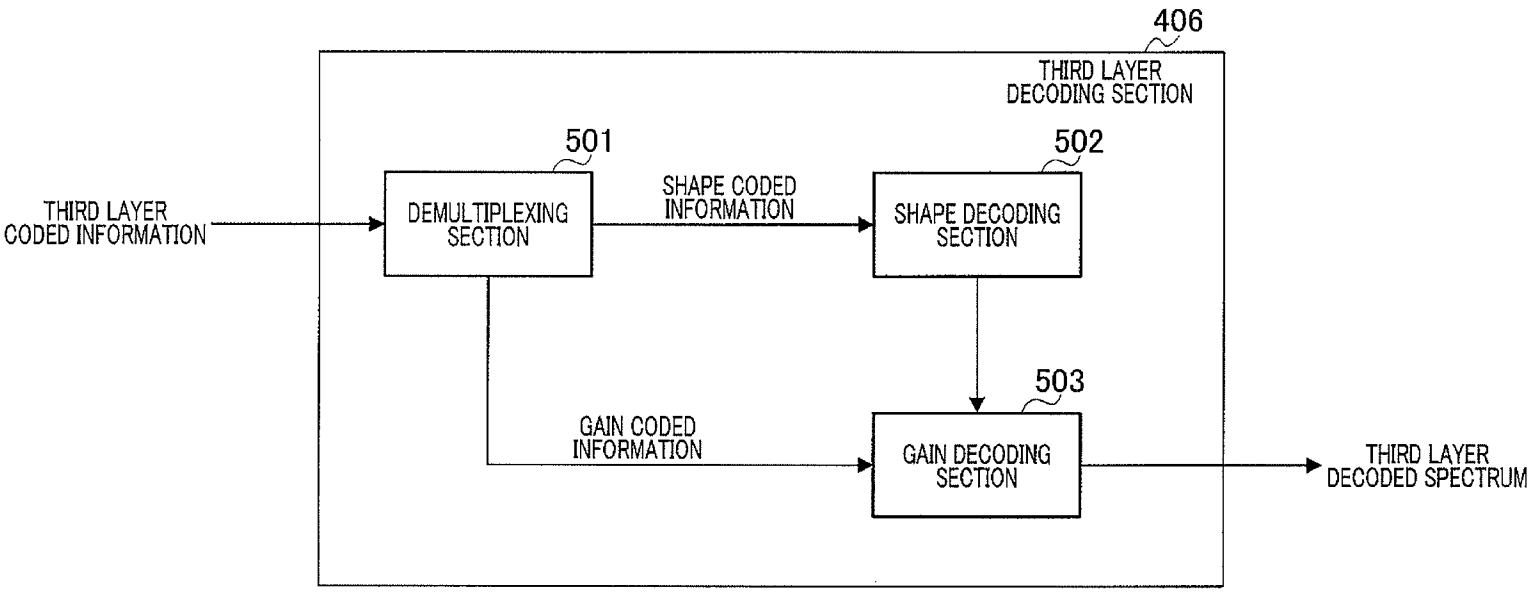
FIG. 5 is a block diagram illustrating a main internal configuration of the third layer decoding section shown in FIG. 4.

FIG. 5 is a block diagram illustrating a main configuration of third layer decoding section 406.

In FIG. 5, third layer decoding section 406 includes demultiplexing section 501, shape decoding section 502, and gain decoding section 503.

Demultiplexing section 501 demultiplexes the third layer coded information outputted from coded information demultiplexing section 401 into shape coded information and gain coded information, outputs the obtained shape coded information to shape decoding section 502 and outputs the obtained gain coded information to gain decoding section 503.

Shape decoding section 502 decodes the shape coded information inputted from demultiplexing section 501 and outputs the value of the shape obtained to gain decoding section 503. Shape decoding section 502 incorporates a shape codebook similar to the shape codebook provided in shape coding section 301 of third layer coding section 210. Shape decoding section 502 searches a shape code vector in which shape coded information S_max inputted from demultiplexing section 501 is used as an index. Shape decoding section 502 outputs the searched shape code vector to gain decoding section 503. Here, suppose the shape code vector searched as the shape value is expressed by Shape_q(k) (k=0, . . . , B(j)−1).

Gain decoding section 503 receives gain coded information from demultiplexing section 501 as input. Gain decoding section 503 incorporates a gain codebook similar to the gain codebook provided in gain coding section 302 in third layer coding section 210, and dequantizes the gain value using this gain codebook according to equation 21 below. Here, gain decoding section 503 also deals with the gain value as an L-dimensional vector to perform vector dequantization. Here, predictive gain β(j) is a value referenced from the above-described gain codebook using the index indicated by the gain coded information.

(Equation 21)

$$\text{Gain_}q'(j) = GC_j^{G_min} + \beta(j)(j = 0, \ldots, L-1) \quad [21]$$

The processing in equation 21 corresponds to the inverse processing in equation 17 used by third layer coding section 210 in coding apparatus 101 to search the gain code vector. That is, instead of using gain code vector $GC_j^{G_min}$ corresponding to gain coded information G_min as the gain value as is, a value obtained by adding predictive gain β(j) to gain code vector $GC_j^{G_min}$ is used as the gain value. Of course, the value of predictive gain β(j) referenced here has the same value as predictive gain β(j) referenced when the gain information is encoded.

Next, gain decoding section 503 calculates a decoded MDCT coefficient as third layer decoded spectrum X3(k) according to equation 22 below using the gain value obtained through dequantization of the current frame and the shape value inputted from shape decoding section 502. Here, the calculated decoded MDCT coefficient is expressed by X3(k).

(Equation 22)

$$X3(k) = \text{Gain_}q'(j) \cdot \text{Shape_}q'(k) \begin{pmatrix} k = 0, \ldots, B(j)-1 \\ j = 0, \ldots, L-1 \end{pmatrix} \quad [22]$$

Gain decoding section 503 outputs third layer decoded spectrum X3(k) calculated according to equation 22 above to adder 407.

The processing of third layer decoding section 406 has been described above.

Hereinafter, more specific processing of orthogonal transform processing section 408 will be described below.

Orthogonal transform processing section 408 incorporates buffer buf4(k) and initializes buffer buf4(k) as shown in equation 23 below.

(Equation 23)

$$\text{buf4}(k)=0(k=0, \ldots, N-1) \quad [23]$$

Furthermore, orthogonal transform processing section 408 calculates and outputs decoded signal $y_n$ according to equation 24 below using second addition spectrum X_add(k) inputted from adder 407.

(Equation 24)

$$y_n = \frac{2}{N}\sum_{n=0}^{2N-1} Z2(k)\cos\left[\frac{(2n+1+N)(2k+1)\pi}{4N}\right] \quad [24]$$

$$(n = 0, \ldots, N-1)$$

Z2(k) in equation 24 is a vector formed by coupling second addition spectrum X_add(k) and buffer buf4(k) as shown in equation 25 below.

(Equation 25)

$$Z2(k) = \begin{cases} buf4(k) & (k = 0, \ldots N-1) \\ \text{X_add}(k) & (k = N, \ldots 2N-1) \end{cases} \quad [25]$$

Next, orthogonal transform processing section 408 updates buffer buf4(k) according to equation 26 below.

(Equation 26)

$$\text{buf4}(k)=X_\text{add}(k)(k=0, \ldots N-1) \quad [26]$$

Next, orthogonal transform processing section 408 outputs decoded signal $y_n$ as the output signal.

The internal configuration of decoding apparatus 103 has been described above.

Thus, according to the present embodiment, when the coding apparatus/decoding apparatus uses a hierarchy coding/decoding scheme and also applies to a lower layer, a band extension technology of encoding spectrum data in a high-frequency part based on spectrum data in a low-frequency part, it is also possible to efficiently encode a difference spectrum (difference signal) and improve the quality of a decoded signal even in a higher layer. To be more specific, second layer decoding section 207 that performs band extension processing calculates a spectrum (difference spectrum) which becomes the coding target in third layer coding section 210 of the higher layer not using the gain information (second gain parameter $\alpha_2$) for adjusting the energy of the spectrum in the high-frequency part generated using the spectrum of the low-frequency part, but using such gain information (first gain parameter $\alpha_1$) that minimizes the energy of the difference spectrum. This enables third layer coding section 210 in the higher layer to encode the difference spectrum having smaller energy, and can thereby improve coding efficiency.

Furthermore, third layer coding section 210 quantizes an error component obtained by subtracting from gain information, a gain value (corresponding to predictive gain β(j)) statistically calculated from gain information (corresponding to above-described second gain parameter $\alpha_2$) calculated at the time of band extension processing, as the gain information of the difference spectrum. This makes it possible to further improve coding efficiency.

The present embodiment has described the configuration of switching between methods of calculating a difference spectrum (second layer difference spectrum) in a lower layer in frame units, as shown in equation 19. However, the present invention is not limited to this, but is likewise applicable to a configuration of switching between methods of calculating a difference spectrum in sub-band units in a frame. For example, the present invention is also applicable to a case as disclosed in Non-Patent Literature 2 where a higher layer selects a band which is a quantization target in every frame (BS-SGC (Band Selective Shape Gain Coding) in Non-Patent Literature 2 corresponds to this). In this case, for a sub-band selected by the higher layer as the quantization target, the lower layer performs processing in the case of CI=0 in equation 19 to calculate a difference spectrum. Furthermore, for a sub-band not selected as the quantization target, the lower layer performs processing in the case of CI=1 in equation 15 to calculate a difference spectrum. By this means, it is possible to improve the coding efficiency of the higher layer by switching between methods of calculating a difference spectrum for each sub-band.

The present embodiment has described, by way of example, the configuration in which the error component is quantized as gain information of the difference spectrum in a higher layer rather than the layer that performs band extension processing. Here, the "error component" is a component obtained by subtracting the gain value (predictive gain β(j) corresponds to this) statistically calculated from gain information (above-described second gain parameter $\alpha_2$ corresponds to this) calculated at the time of band extension processing. However, the present invention is not limited to this, but the present invention is likewise applicable to, for example, a configuration in which the higher layer quantizes gain information without using predictive gain β(j). In this case, though the quantization accuracy of the gain information slightly deteriorates, predictive gain β(j) need not be stored in the codebook, and this leads to a reduction of memory. Furthermore, the present invention is likewise applicable, for example, to a configuration in which the higher layer divides gain information by a gain value (predictive gain β(j) corresponds to this) statistically calculated from the gain information and quantizes the division result as an error component. Furthermore, since the amount of processing/calculation of the division increases in this case, a configuration may also, of course, be adopted in which the reciprocal of predictive gain β(j) is stored in the codebook beforehand and multiplication instead of division is performed when the division result is actually calculated. Furthermore, in this case, during decoding in the decoding apparatus, to correspond to the processing in the coding apparatus, a final decoding gain value is calculated by multiplying (or dividing) the decoding gain by predictive gain β(j) instead of adding predictive gain β(j) to the decoding gain.

A case has been described in the present embodiment as an example where the first layer coding section/decoding section adopts a CELP type coding/decoding method, but the present invention is not limited to this. The present invention is likewise applicable to a case where a coding method other than the CELP type or a coding method on the frequency axis is adopted. When the first layer coding section adopts a coding method on the frequency axis, may be possible to perform orthogonal transform processing on an input signal to first, then encode the low-frequency part and input the decoded spectrum obtained to the second layer coding section as is. This eliminates the necessity for processing in the down-sampling processing section, up-sampling processing section or the like in this case.

Furthermore, the decoding apparatus according to the present embodiment performs processing using coded information transmitted from the above-described coding apparatus. However, the present invention is not limited to this, and the decoding apparatus can perform processing on any type of coded information including necessary parameters or data even if it is not necessarily coded information from the above-described coding apparatus.

In addition, the present invention is also applicable to cases where this signal processing program is recorded and written on a machine-readable recording medium such as memory, disk, tape, CD, or DVD, achieving behavior and effects similar to those of the present embodiment.

Also, although cases have been described with Embodiment as an example where the present invention is configured by hardware, the present invention can also be realized by software.

Each function block employed in the description of Embodiment may typically be implemented as an LSI constituted by an integrated circuit. These may be implemented individually as single chips, or a single chip may incorporate some or all of them. Here, the term LSI has been used, but the terms IC, system LSI, super LSI, and ultra LSI may also be used according to differences in the degree of integration.

Further, the method of circuit integration is not limited to LSI, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI as a result of the advancement of semiconductor technology or a derivative other technology, it is naturally also possible to carry out function block integration using this technology. Application of biotechnology is also possible.

The present invention contains the disclosures of the specification, the drawings, and the abstract of Japanese Patent Application No. 2009-258841 filed on Nov. 12, 2009, the entire contents of which being incorporated herein by reference.

INDUSTRIAL APPLICABILITY

When a technology (band extension technology) of performing band extension using a low-frequency spectrum to estimate a high-frequency spectrum is applied to a hierarchy coding/decoding scheme, the coding apparatus, decoding apparatus and the methods thereof according to the present invention can efficiently perform encoding in a higher layer as well, improve the quality of the decoded signal, and are suitable for use, for example, in a packet communication system or mobile communication system.

REFERENCE SIGNS LIST

101 coding apparatus
102 transmission line
103 decoding apparatus
201 down-sampling processing section
202 first layer coding section
203, 402 first layer decoding section
204, 403 up-sampling processing section
205, 404, 408 orthogonal transform processing section
206 second layer coding section
207, 405 second layer decoding section
208, 209, 407 adder
210 third layer coding section
211 coded information integration section
301 shape coding section
302 gain coding section
303 multiplexing section
401 coded information demultiplexing section
406 third layer decoding section
501 demultiplexing section
502 shape decoding section
503 gain decoding section

The invention claimed is:

1. A coding apparatus comprising:

a first coding section that inputs a low-frequency decoded signal of a frequency domain generated using low-frequency coded information obtained by encoding an input signal and the input signal of the frequency domain, generates a high-frequency decoded signal of the frequency domain using high-frequency coded information obtained through encoding using the low-frequency decoded signal and the input signal, generates a band extension signal using the low-frequency decoded signal and the high-frequency decoded signal and generates a difference signal between the input signal and the band extension signal; and a second coding section that encodes the difference signal to generate difference coded information, wherein:

the first coding section searches a part approximate to the high-frequency part of the input signal from the low-frequency decoded signal in encoding using the low-frequency decoded signal and the input signal to thereby obtain an ideal gain that minimizes energy of the difference signal, generate the difference signal that minimizes the energy and generate the high-frequency coded information including the ideal gain.

2. The coding apparatus according to claim 1, wherein the second coding section selects some sub-bands from among a plurality of sub-bands obtained by dividing the frequency domain as coding target bands and encodes the difference signal of the selected coding target bands.

3. The coding apparatus according to claim 1, wherein the second coding section is combined in a hierarchical manner.

4. The coding apparatus according to claim 1, wherein the first coding section generates an adjustment gain, as the high-frequency coded information, for adjusting sub-band energy of a signal generated using information indicating a position of part of the low-frequency decoded signal most approximate to the high-frequency part of the input signal, the ideal gain when the part of the low-frequency decoded signal is the most approximate and the part of the most approximate low-frequency decoded signal, and generates the high-frequency decoded signal based on the high-frequency coded information except the adjustment gain.

5. The coding apparatus according to claim 4, wherein:

the second coding section comprises a shape/gain coding section that encodes the shape and gain of the difference signal to generate shape coded information and gain coded information, and the shape/gain coding section generates the gain coded information based on the adjustment gain.

6. The coding apparatus according to claim 4, wherein:

the second coding section comprises a shape/gain coding section that encodes the shape and gain of the difference signal to generate shape coded information and gain coded information, and the shape/gain coding section generates the gain coded information based on the ideal gain and a predicted gain statistically calculated using the adjustment gain.

7. A decoding apparatus comprising:

a receiving section that receives coded information, which is generated by a coding apparatus, including low-frequency coded information obtained by encoding an input signal, high-frequency coded information obtained through encoding using a low-frequency signal generated using the low-frequency coded information and the input signal, and difference coded information generated through encoding using a difference signal between a band extension signal and the input signal, the band extension signal generated using a high-frequency signal generated using the high-frequency coded information and the low-frequency signal, the coded information, the high-frequency coded information of which includes an ideal gain that minimizes energy of the difference signal;

a first decoding section that decodes the low-frequency coded information to generate a low-frequency decoded signal;

a second decoding section that performs decoding using the low-frequency decoded signal and the high-frequency coded information to thereby generate a high-frequency decoded signal; and a third decoding section that decodes the difference coded information, wherein:

the receiving section generates control information indicating whether or not the coded information includes the difference coded information, and the second decoding section performs decoding by switching between a first decoding method using all information included in the high-frequency coded information and a second decoding method using information included in the high-frequency coded information except specific information, based on the control information.

8. The decoding apparatus according to claim 7, wherein the second decoding section generates, when the control information indicates that the coded information does not include the difference coded information, the high-frequency decoded signal using the first decoding method.

9. The decoding apparatus according to claim 7, wherein when the control information indicates that the coded information includes the difference coded information, the second decoding section generates the high-frequency decoded signal using the second decoding method for a band in which the difference coded information is decoded in the third decoding section, and for a band in which the difference coded information is not decoded in the third decoding section, the second decoding section generates the high-frequency decoded signal using the first decoding method.

10. The decoding apparatus according to claim 7, wherein:

the receiving section receives the coded information, which is generated by the coding apparatus, including an adjustment gain for adjusting sub-band energy of a signal generated using information indicating a position of part of the low-frequency signal most approximate to the high-frequency part of the input signal, the ideal gain when the part of the low-frequency signal is the most approximate and the part of the most approximate low-frequency signal, as the high-frequency coded information, and the second decoding section generates, when the second decoding method is used, the high-frequency decoded signal using information included in the high-frequency coded information except the adjustment gain, as the specific information.

11. The decoding apparatus according to claim 10, wherein:

the third decoding section comprises a shape/gain decoding section that decodes shape coded information and gain coded information included in the difference coded information and generated by the coding apparatus encoding the shape and gain of the difference signal, and the shape/gain decoding section decodes the gain coded information based on the adjustment gain.

12. The decoding apparatus according to claim 10, wherein the third decoding section comprises a shape/gain decoding section that decodes shape coded information and gain coded information included in the difference coded information and generated by the coding apparatus encoding the shape and gain of the difference signal, and the shape/gain decoding section decodes the gain coded information based on a predicted gain statistically calculated using the ideal gain and the adjustment gain.

13. A communication terminal apparatus comprising the coding apparatus according to claim 1.

14. A base station apparatus comprising the coding apparatus according to claim 1.

15. A communication terminal apparatus comprising the decoding apparatus according to claim 7.

16. A base station apparatus comprising the decoding apparatus according to claim 7.

17. A coding method comprising:

a first encoding step of inputting a low-frequency decoded signal of a frequency domain generated using low-frequency coded information obtained by encoding an input signal and the input signal of the frequency domain, generating a high-frequency decoded signal of the frequency domain using high-frequency coded information obtained through encoding using the low-frequency decoded signal and the input signal, generating a band extension signal using the low-frequency decoded signal and the high-frequency decoded signal and generating a difference signal between the input signal and the band extension signal; and a second encoding step of encoding the difference signal to generate difference coded information, wherein:

in the first encoding step, a part approximate to a high-frequency part of the input signal is searched from the low-frequency decoded signal in encoding using the low-frequency decoded signal and the input signal to thereby obtain an ideal gain that minimizes energy of the difference signal, and generate the difference signal that minimizes the energy and generate the high-frequency coded information including the ideal gain.

18. A decoding method comprising:

a receiving step of receiving coded information, that is generated by a coding apparatus, including low-frequency coded information obtained by encoding an input signal, high-frequency coded information obtained through encoding using a low-frequency signal generated using the low-frequency coded information and the input signal, and difference coded information generated through encoding using a difference signal between a band extension signal and the input signal, the band extension signal generated using a high-frequency signal generated using the high-frequency coded information and the low-frequency signal, the coded information, the high-frequency coded information of which includes an ideal gain that minimizes energy of the difference signal;

a first decoding step of decoding the low-frequency coded information to generate a low-frequency decoded signal;

a second decoding step of performing decoding using the low-frequency decoded signal and the high-frequency coded information to thereby generate a high-frequency decoded signal; and a third decoding step of decoding the difference coded information, wherein:

in the receiving step, control information indicating whether or not the coded information includes the difference coded information is generated, and in the second decoding step, decoding is performed by switching between a first decoding method using all information included in the high-frequency coded information and a second decoding method using information included in the high-frequency coded information except specific information, based on the control information.

* * * * *